United States Patent [19]

Washecheck et al.

[11] Patent Number: 4,776,945

[45] **Date of Patent: * Oct. 11, 1988**

[54] SINGLE-STAGE HYDROTREATING PROCESS

[75] Inventors: Don M. Washecheck, Katy; Charles T. Adams, Houston, both of Tex.

[73] Assignee: Shell Oil Company, Houston, Tex.

[ * ] Notice: The portion of the term of this patent subsequent to Aug. 32, 2002 has been disclaimed.

[21] Appl. No.: 735,620

[22] Filed: May 21, 1985

Related U.S. Application Data

[63] Continuation-in-part of Ser. No. 676,742, Nov. 30, 1984, Pat. No. 4,534,852.

[51] Int. Cl.[4] ..... C10G 45/06

[52] U.S. Cl. ..... 208/89; 208/210; 208/251 H

[58] Field of Search ..... 208/89, 210, 251 H, 208/216 R, 57

[56] References Cited

U.S. PATENT DOCUMENTS

| | | | |
|---|---|---|---|
| 3,392,112 | 7/1968 | Bercik et al. | 208/210 |
| 3,766,058 | 10/1973 | Hensley | 208/210 |
| 4,006,076 | 2/1977 | Christensen et al. | 208/211 |
| 4,016,049 | 4/1977 | Fozzard et al. | 203/60 |
| 4,048,060 | 9/1977 | Riley | 208/210 |
| 4,166,026 | 8/1979 | Fukui et al. | 208/210 |
| 4,392,945 | 7/1983 | Howard et al. | 208/210 |
| 4,431,526 | 2/1984 | Simpson et al. | 208/251 H X |
| 4,534,852 | 8/1985 | Washecheck et al. | 208/89 |

*Primary Examiner*—W. J. Shine

*Assistant Examiner*—Glenn Caldarola

*Attorney, Agent, or Firm*—Pamela J. McCollough

[57] ABSTRACT

A process is provided for hydrotreating hydrocarbon oils having a tendency to deactivate hydrotreating catalysts by coke formation, said oils selected from the group consisting of (a) oils having a final boiling point greater than about 1000° F. and containing less than about 2% by weight of heptane asphaltenes, (b) oils having a final boiling point from about 650° F. to about 1000° F. and (c) mixtures thereof, which comprises:

passing said oils downwardly with a hydrogen-containing gas into a hydrotreating zone over a stacked-bed of two hydrotreating catalysts under conditions suitable to convert greater than about 25% of the sulfur compounds present to $H_2S$; said stacked bed comprising an upper bed consisting of about 15–85% v, basis total catalyst, of a high-activity hydrotreating catalyst containing from about 2–4% w nickel, from about 8–15% w molybdenum and from about 1–4% w phosphorus supported on a carrier consisting mostly of alumina; and a lower bed consisting of about 15–85% v, basis total catalyst, of a high-activity desulfurization catalyst which contains from about 2–4% w cobalt and/or nickel and from about 8–15% w molybdenum and less than about 0.5% w phosphorus supported on a carrier consisting mostly of alumina; and separating the reaction product from said hydrotreating zone into a hydrogen-rich gas and a liquid hydrocarbon oil having reduced sulfur and/or heavy metal content.

34 Claims, 2 Drawing Sheets

SINGLE-STAGE HYDROTREATING PROCESS

This is continuation-in-part of co-pending application Ser. No. 676,742, filed Nov. 30, 1984, now U.S. Pat. No. 4,534,852, issued Aug. 13, 1985.

BACKGROUND OF THE INVENTION

This invention relates to a single stage hydrorefining process for treating heavy oils using two particular catalysts arranged in a particular manner, referenced to herein as "stacked bed". It particularly relates to a single stage hydrorefining process for treating oils having a tendency to deactivate hydrotreating catalysts by coke formation, these being oils with high boiling components and/or oils with a low asphaltene content and very high boiling components, with a particular stacked bed catalyst arrangement. The use of the stacked bed increases the catalyst life or allows increased conversions relative to the more traditional catalysts used for the treating of these oils. The invention is particularly useful for meeting the demands of increasing hydrotreatment severity, such as sulfur removal, for poorer quality heavy oil fractions both directly distilled or extracted from crude or crude fraction and oil fractions from thermal, steam, or catalytic cracking processes including mixtures of any of these materials.

The continual changes in the refining industry such as the trend to poorer quality crudes and the continual increase in the stringency of oil product specifications (e.g. lower allowed sulfur content) is in part requiring the refiner to increase the severity of hydrotreating of traditional oil fractions and/or process fractions not traditionally treated. The increased severity and/or unusual feed generally have been causing increased deactivation of hydrotreating catalysts. The invention herein disclosed can be used with these oil fractions to increase the run length of a hydrotreating process and/or allow higher severity operation and/or process poorer quality oils.

The use of lower price or locally available crudes frequently results in increased sulfur and/or nitrogen content of the oil fractions. Conversion processes such as thermal cracking, coking and catalytic cracking are either being brought on-stream or are processing poorer quality oils. The products from such processes are laden with heteroatoms such as sulfur and are more hydrogen deficient relative to products from better quality crudes or oils distilled directly from crude or crude fractions. As a result, the products of the conversion processes and/or poorer crudes have to be hydrotreated to meet specifications or to prepare for further treating/conversion. However, the higher operating temperatures required to remove the additional heteroatoms and add additional hydrogen in addition to the hydrogen-deficient coke-like nature of these feeds results in increasing deactivation of the hydrotreating catalysts due to coking. Any increase in hydrotreating catalyst activity and/or stability enables refiners to upgrade the lower value poor quality and/or cracked oils at a significant economic benefit.

It is well known that the hydrogen-deficient poor quality oils can be hydrotreated/hydrorefined with low catalyst deactivation rates at higher hydrorefining unit conditions—higher hydrogen pressure, and/or hydrogen-to-oil ratio, and/or oil-catalyst contact time. To stay within the physical or design constraints of the unit or continue to process the required volumes of oil, only relatively small variations in these parameters can be made. As a result, very expensive hydrotreating equipment must be added to meet the changing goals unless catalysts with longer lives are available. Alternatively, the refiner can accept very short catalyst lives and increased down time for frequent catalyst changes or use continuous or semicontinuous regeneration facilities. Larger and/or more vessels and additional equipment would be needed to process a given quantity of feed stock with these options. Of particular importance to a refiner is the ability to process the hydrogen-deficient and/or poorer quality oils in existing hydrotreating units which do not have sufficient hydrogen pressure to prevent uneconomically rapid catalyst activity loss with existing catalysts utilized in a non-stacked bed configuration. Thus, improved processes and highly stable catalysts are in great demand.

Several two-stage hydrotreating processes have been proposed to overcome some of the difficulties of hydrotreating heavy oils. The five patents discussed below use two catalyst reactor vessels, and are incorporated herein by reference.

U.S. Pat. No. 3,766,058 discloses a two-stage process for hydrodesulfurizing high-sulfur vacuum residues. In the first stage some of the sulfur is removed and some hydrogenation of feed occurs, preferably over a cobalt-molybdenum catalyst supported on a composite of ZnO and $Al_2O_3$. In the second stage the effluent is treated under conditions to provide hydrocracking and desulfurization of asphaltenes and large resin molecules contained in the feed, preferably over molybdenum supported on alumina or silica, wherein the second catalyst has a greater average pore diameter than the first catalyst.

U.S. Pat. No. 4,016,049 discloses a two-stage process for hydrodesulfurizing metal- and sulfur-containing asphaltenic heavy oils with an interstage flashing step and with partial feed oil bypass around the first stage.

U.S. Pat. No. 4,048,060 discloses a two-stage hydrodesulfurization and hydrodemetallization process utilizing a different catalyst in each stage, wherein the second stage catalyst has a larger pore size than the first catalyst and a specific pore size distribution.

U.S. Pat. No. 4,166,026 teaches a two-step process wherein a heavy hydrocarbon oil containing large amounts of asphaltenes and heavy metals is hydrodemetallized and selectively cracked in the first step over a catalyst which contains one or more catalytic metals supported on a carrier composed mainly of magnesium silicate. The effluent from the first step, with or without separation of hydrogen-rich gas, is contacted with hydrogen in the presence of a catalyst containing one or more catalytic metals supported on a carrier, preferably alumina or silica-alumina having a particular pore volume and pore size distribution. This two-step method is claimed to be more efficient than a conventional process wherein a residual oil is directly hydrodesulfurized in a one-step treatment.

U.S. Pat. No. 4,392,945 discloses a two-stage hydrorefining process for treating heavy oils containing certain types of organic sulfur compounds by utilizing a specific sequence of catalysts with interstage removal of $H_2S$ and $NH_3$. A nickel-containing conventional hydrorefining catalyst is present in the first stage. A cobalt-containing conventional hydrorefining catalyst is present in the second stage. The first stage is preferably operated under conditions to effect at least 50%w desulfurization, while the second stage is preferably operated under conditions to achieve at least about 90%w desulfurization, relative to the initial oil feed sulfur of the first stage. This process is primarily applicable to distillate gas oil feeds boiling below about 650° F. which contain little or no heavy metals.

All of the above referenced patents relate to two-stage hydrotreating processes for various hydrocarbon oils utilizing certain advantageous catalysts and/or supports. Some of these patents require removal of $H_2S$ and $NH_3$ and others do not. However, none have described a process whereby oils with final boiling points from about 650° F. to 1000° F. and/or oil with a low asphaltene content and with components boiling above about 1000° F. can be hydrotreated with significantly improved catalyst life relative to a single catalyst system. Applicants have found that by using a specific stacked-bed catalyst arrangement containing two different catalytically active compositions, oils with high boiling components (about 650° F.–1000° F.) and/or oil with a low asphaltene content and with very high boiling components (greater than about 1000° F.) can be treated in a single stage hydrotreating process with improved catalyst-system life and/or increased hydrotreating conversions for a given feed stock. This process allows easy conversion of existing catalytic hydrotreating reactors to a stacked bed of specified catalysts. The process operates well at hydrogen pressures below about 1100 psig, so that no additional high pressure reactors need be constructed. The particular stacked bed combination of catalysts of the invention results in longer runs between replacements or regenerations for a given oil than would be experienced with either catalyst used alone. Alternatively, poorer quality oils can be processed at equivalent conversions or higher conversions for a given oil can be maintained with the same time between replacement or regeneration with the use of this invention. The invention is most useful for situations where rapid catalyst deactivation is occurring.

SUMMARY OF THE INVENTION

In co-pending application Ser. No. 676,742, filed Nov. 30, 1984, now U.S. Pat. No. 4,534,852, issued Aug. 13, 1985, it was shown that a stacked catalyst bed provided significant advantages when hydrotreating oils with final boiling points of greater than about 1000° F. and with asphaltene contents greater than about 2%. It has now been found that similar advantages are obtained when the herein-described stacked bed is used to hydrotreat oils with final boiling points greater than about 1000° F. and with heptane asphaltenes content less than about 2%w, oils with final boiling points between about 650° F. to about 1000° F. and mixtures thereof.

According to the present invention a process is provided for hydrotreating oils having a tendency to deactivate hydrotreating catalysts by coke formation, said oils being: (a) oils with final boiling points from about 650° F. to about 1000° F., (b) oils with a final boiling point greater than about 1000° F. and with a heptane asphaltenes content less than 2%w, and (c) mixtures of (a) and (b) which comprises: passing hydrogen (or a hydrogen-containing gas) and said oil downwardly into a hydrotreating zone over a stacked-bed catalyst under conditions suitable to convert more than about 25% of the sulfur compounds present in the mixture to $H_2S$; wherein said stacked bed comprises an upper zone consisting of from about 15–85%v, basis total main catalyst charge, of a high-activity hydrotreating catalyst which contains from about 2–4%w nickel, from about 8–15%w molybdenum and from about 1–4%w phosphorus supported on a carrier consisting mostly of alumina, and a lower zone of a high-activity, hydrodesulfurization catalyst consisting of from about 2–4%w cobalt and/or nickel, from about 8–15%w molybdenum and less than about 0.5%w phosphorus supported on a carrier consisting mostly of alumina; and separating the reaction product from said hydrotreating zone into a hydrogen-rich gas and a liquid oil having reduced heteroatom content and increased hydrogen content. The invention is particularly suitable for systems where catalyst deactivation due to coking is a constraint. The bottom bed catalyst is preferably Ni-promoted when nitrogen removal is the predominant concern and is preferably Co-promoted when sulfur removal is the predominant concern.

DETAILED DESCRIPTION OF THE INVENTION

Figure 1:
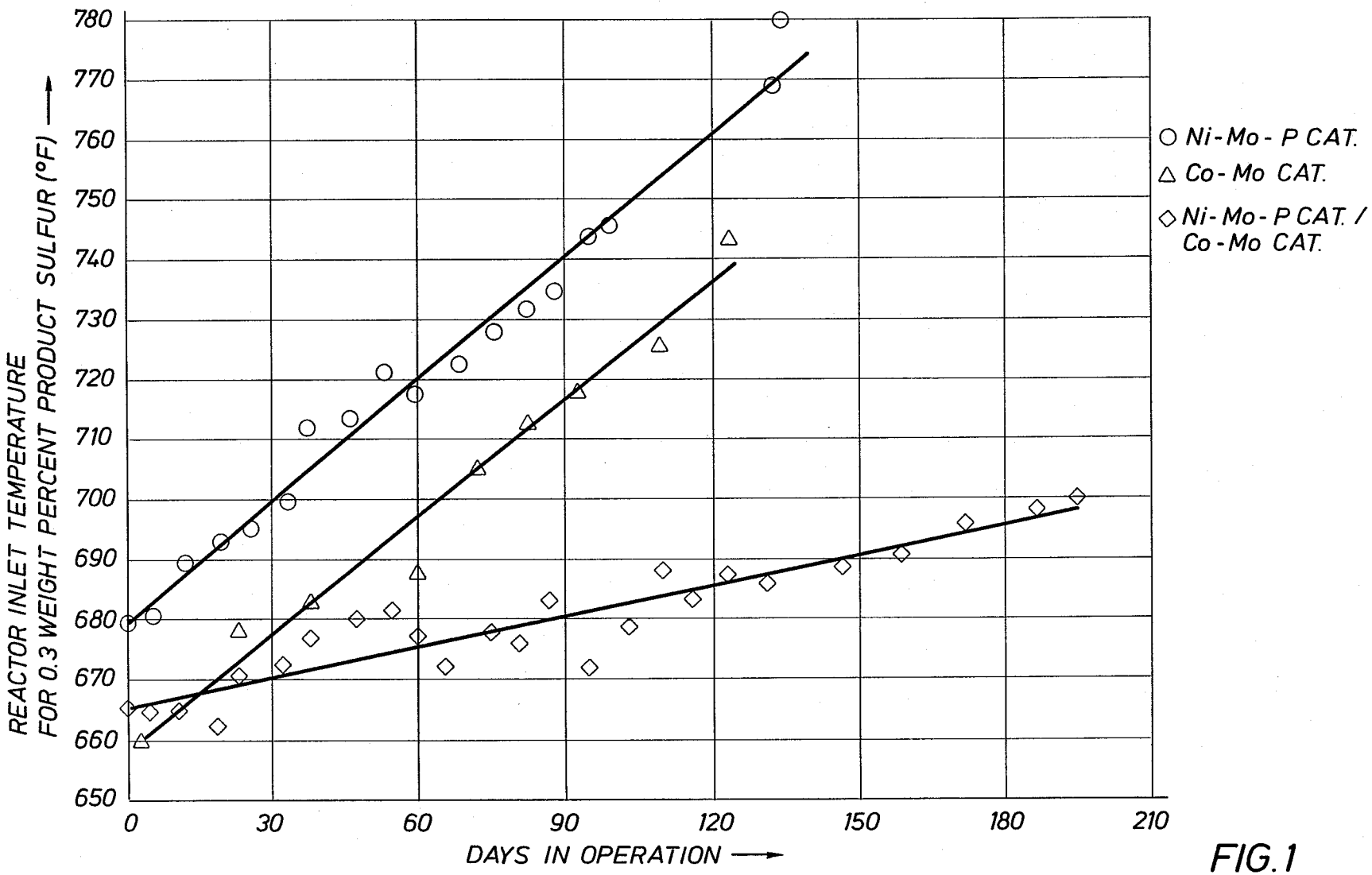
FIG. 1 shows the advantage obtained in the reactor inlet temperature as a function of time when the stacked bed of the instant invention is utilized.

According to the present invention oils with (a) final boiling points in the range between about 650° F. and about 1000° F., oils with final boiling points greater than about 1000° F. and with a heptane asphaltenes content less than about 2% by weight or mixtures thereof are contacted with a hydrogen containing gas and passed downwardly in a single stage under hydrodesulfurization conditions over a preferred stacked bed of catalysts. For the present invention, the boiling points are defined by the American Society For Testing And Materials (ASTM) method D 2887-83 ("Boiling Range Distribution of Petroleum Fractions by Gas Chromatography") and is commonly known as TBP-GLC or true boiling point by gas liquid chromatography. Normal heptane asphaltenes (asphaltenes) as discussed in this invention are measured by the Institute of Petroleum, London, method IP 143/78 ("Asphaltenes Precipitation with Normal Heptane").

The oils utilized herein will be oils having a tendency to deactivate hydrotreating catalysts by coke formation, under hydrotreating conditions and particularly under hydrodesulfurization conditions.

Downwardly has been used in this specification to indicate a direction and not an orientation and hence should not be construed to imply an orientation limitation on the instant invention. A downwardly series flow of oil and gas through a reactor is the usual pattern; however, one could invert the reactor conceptually and put oil and gas in at the bottom in which the first catalyst zone (Ni- and P-containing catalyst) should be the first main catalyst contacted by the oil and gas and would be in the bottom of the first reactor. As is well known in the industry, multiple reactors connected in series are placed individually. Oil and gas out of one reactor is piped up to the top of the next reactor; however, this process could be inverted. The above-described reactor configurations, as well as others apparent to those skilled in the art, are deemed to be within the scope of this invention.

The feed stocks for this invention may be taken from straight run oils (non-cracked) or thermally, steam, or catalytically cracked hydrocarbonaceous materials. Suitable feeds include petroleum derived gas oils distilled from crude or crude fractions at about atmospheric or at reduced pressure; solvent extracted oils such as extracted oils commonly known as Deasphalted Oil; thermally or steamed cracked oils or fractions thereof such as coker gas oils; gas oils or cycle oils from catalytic cracking and mixtures of the above materials.

Multiple uses of these feed stocks after treating with the process of this invention are possible. Depending on particular feed stocks treated, suitable uses can include feed and additions to feed to units for significant molecular weight reduction such as catalytic cracking units or hydrocracking units; direct use or by blending with other oils or additives for sale as transportation fuels such as diesel oils; or for refinery fuel.

The stacked-bed catalyst system for use in this process consists of a first catalyst of a Ni- and P-containing conventional hydrotreating catalyst. The second catalyst contacted by the oil consists of a low-phosphorus content conventional catalyst. Preferably, the second catalyst contains no phosphorus. The second catalyst is also a conventional catalyst and contains Ni and/or Co in the formulation. When desulfurization is the primary objective of the hydrotreating process, the second catalyst contains Co in preference to Ni; when denitrogenation is the primary objective, the second catalyst preferably contains Ni in preference to Co. The catalysts herein can be prepared by techniques well known in the art. The advantages of this invention accrue from the particular combination of operable hydrotreating catalysts in a stacked bed rather than from any particular method or manner of fabricating the catalyst.

The first main hydrotreating zone catalyst used in the present invention is a Ni- and P-containing conventional hydrotreating catalyst. Conventional hydrotreating catalysts which are suitable for the first catalyst zone generally comprise a phosphorus oxide and/or sulfide component and a component, selected from group VIB of the Periodic Table and a group VIII metal, metal oxide, or metal sulfide and mixtures thereof composited with a support. These catalysts will contain from 0 to about 10 percent, usually about 1 to about 5 percent by weight of the group VIII metal compound calculated basis the metal content, from about 3 to about 15 percent by weight of the group VIB metal compound calculated basis the metal content, and from about 0.1 to about 10 percent phosphorus compounds calculated basis phosphorus content. Preferably, the catalyst comprises a nickel component and a molybdenum and/or tungsten component with an alumina support which may additionally contain silica. A more preferred embodiment is a nickel component, a molybdenum component, and a phosphorus component with an alumina support which may also contain silica in small amounts. Preferred amounts of nickel component is from about 2 to about 4 percent by weight calculated basis metal content, about 11–15 percent by weight of the molybdenum component calculated basis metal content, and about 1 to about 4 percent, more preferably about 2 to about 4 percent, of the phosphorus component calculated basis the phosphorus content. The catalyst can be used in a variety of shapes. Preferably, the catalyst is sulfided prior to use, as is well known to the art.

The use of low-phosphorus or no-phosphorus catalysts in the second zone is thought to be of benefit due to reduced deactivation by coking. Phosphorus may promote coking through an acid catalyzed condensation of coke precursors. A high activity catalyst is desired in order to reduce the required operating temperatures. High temperatures lead to increased coking.

The low-phosphorus content catalyst used for the second zone is preferably, a high activity conventional catalyst. Such catalysts have high surface areas (greater than about 200 $m^2$/gm) and high compacted bulk densities (about 0.6–0.85 gm/cc). The high surface area increases reaction rates due to generally increased dispersion of the active components. Higher density catalysts allow one to load a larger amount of active metals and promoter per reaction volume, a factor which is commercially important. The metal content specified above provides high activity per reactor volume. Lower metal contents result in catalysts with activity too low for use in the present invention. With higher metal loading than specified above, inefficient use of the metals results in high catalyst cost with little advantage. Since deposits of coke are thought to cause the majority of the catalyst deactivation, fresh catalyst pore volume should be at or above a modest level (about 0.4–0.8 cc/gm, more narrowly about 0.5–0.7 cc/gm). The catalyst can be used in a variety of shapes. Preferably, the catalyst is sulfided prior to use as is well known to the art.

The Ni-containing catalyst used for the first zone is preferably a high activity conventional catalyst suitable for high levels of hydrogenation. Such catalysts have high surface areas (greater than about 140 $m^2$/gm) and high compacted bulk densities (about 0.65–0.95 gm/cc, more narrowly about 0.7–0.95 gm/cc). The high surface area increases reaction rates due to generally increased dispersion of the active components. Higher density catalysts allow one to load a larger amount of active metals and promoter per reactor volume, a factor which is commercially important. The metal and phosphorus content specified above provides the high activity per reactor volume. Lower metal contents result in catalysts with activity too low for use in the present invention. Higher metal contents lead to an inefficient use of the metals and higher cost for the catalyst. Since deposits of coke are thought to cause the majority of the catalyst deactivation, fresh catalyst pore volume should be at a modest level (about 0.4–0.8 cc/gm, more narrowly about 0.4–0.6 cc/gm).

A low-phosphorus or no-phosphorus conventional hydrotreating catalyst is used in the second zone of the catalyst system. Either Co containing and/or Ni containing conventional catalysts could be used. This catalyst differs from the first catalyst primarily in the low-phosphorus content (less than 0.5%w). The preferred catalyst contains less than about 0.5%w phosphorus and may comprise a component from group VIB and a group VIII metal, metal oxide, or metal sulfide and mixtures thereof deposited on a support. Preferably, the catalyst comprises a nickel and/or cobalt component and a molybdenum and/or tungten component with an alumina support which may additionally contain silica. Preferred metal contents are from 0 to about 10 usually about 1 to about 5 percent by weight of the group VIII metal components calculated basis the metal content and from about 3 to about 30 percent by weight of the group VIB metal component basis the metal content. A more preferred embodiment is a cobalt or nickel component and a molybdenum component with an alumina support.

The physical characterizations referred to in this invention are common to the catalyst development art. Surface areas refer to nitrogen adsorption surface areas preferably determined by at least three points. Pore size distributions are determined by mercury intrusion and calculated with a 130 degree contact angle. Pore volumes stated are water pore volumes and indicate the volume of water per weight of catalyst necessary to fill the catalyst pores to an incipient wetness of the catalyst.

The volume of the first catalyst zones in the present invention is from about 15 to about 85%v of the main catalyst charge. The remaining fraction of the main catalyst charge is composed of the second catalyst. The division of the catalyst volumes depends upon the requirement for nitrogen conversion versus the requirements for stability and other hydrotreating reactions such as sulfur and metals removal. Stacked beds can be used to tailor the amount of nitrogen removal, sulfur and metals removal, and system stability. An increase in the first catalyst will increase the nitrogen removal but will effect the HDS activity and stability of the system. Below a catalyst ratio of about 15:85 or above a catalyst ratio of about 85:15 (upper:lower) the benefits for the stacked bed system are not large enough to be of commercial use. There is no physical limit on using a smaller percentage of one or the other beds.

The catalyst zones revealed in this invention may be in the same or different reactors. For existing units with one reactor the catalysts are layered one on top of the other. Many hydrotreating reactors consist of two or more reactors in series. The catalyst zones are not restricted to the volume in one vessel and can extend into the next vessel. The zones discussed in this invention refer to the main catalyst bed. Small layers of catalysts which are different sizes are frequently used in reactor loading as is known to those skilled in the art. Intervessel heat exchange and/or hydrogen addition may also be used with this invention.

The pore size of the catalyst is not a critical factor in the present invention. The catalysts in the two zones may use the same carrier. The finished catalysts will have a small difference in their average pore size due the the differences in metal and phosphorus loadings.

Suitable operating conditions for the catalyst system are given in Table 1.

TABLE 1

| CONDITIONS | BROADEST RANGE | BROAD RANGE | NARROW RANGE | NARROWEST RANGE |
|---|---|---|---|---|
| Hydrogen Partial Pressure, psia | 100–1100 | 300–1100 | 300–800 | 500–800 |
| Total Pressure, psig | 200–1400 | 400–1400 | 400–1100 | 700–1100 |
| Hydrogen/Oil Ratio, SCF/BBL | 100–10000 | 100–5000 | 300–1500 | 500–1500 |
| Temperature, °F. | 300–850 | 550–850 | 550–800 | 650–800 |
| Liquid hourly space velocity, V/V/HR | 0.1–10.0 | | 0.5–5.0 | |

At temperatures below about 550° F. (for very heavy feeds) and below about 300° F. (for heavy feeds), the catalysts do not exhibit sufficient activity for the rates of conversion to be practical. At temperatures above about 850° F., the rate of coking and cracking become excessive resulting in impractical operations. Reactor metallurgy may also be a limitation above about 850° F. at the higher pressures.

At liquid space velocities below about 0.1 Hr-1, the residence time of the oil is long enough to lead to thermal degradation and coking. At liquid space velocities above about 10 Hr-1 the conversion across the reactor is too small to be of practical use. For space velocity and gas-to-oil ratio calculations in this invention, volumes are measured at 60° F. and atmospheric pressure.

Hydrogen partial pressure is very important in determining the rate of catalyst coking and deactivation. At pressures below about 100 psia, the catalyst system cokes too rapidly even with better quality oil with high boiling components. At pressures above about 1100 psia, the deactivation mechanism of the catalyst system is predominantly that of metals deposition, if present, which results in pore-mouth plugging. Catalysts of varying porosity can be used to address deactivation by metals deposition, as is known by those skilled in the art. The hydrogen to oil ratio for this invention is required to be above 100 SCF/BBL since the reactions occurring during hydrotreating consume hydrogen resulting in a deficiency of hydrogen at the bottom of the reactor. This deficiency results in rapid coking of the catalyst and an impractical operation. At hydrogen to oil ratios above 5000 SCF/BBL, no substantial benefit is obtained; thus the expense of compression beyond this rate is not warranted.

Nitrogen removal is an important factor in hydrotreating heavy oils. Catalysts without phosphorus can be more stable with heavy oils under the conditions noted above; however, nitrogen removal activity is low for no-phosphorus catalysts relative to their phosphorus promoted counterparts. Additionally, Co promoted catalysts are less active for nitrogen removal than are Ni promoted catalysts. Stacked catalyst beds can be used to tailor the amount of nitrogen removal, sulfur and metals removal, and system stability. We have discovered that a stacked bed system also improves activities (other than nitrogen removal) as well as the stability of the overall catalyst system relative to either catalyst used individually. The stacked bed catalyst system is applicable when processing feeds under conditions where a heavy feed is causing deactivation primarily by coking.

The process should be operated at conditions suitable to remove at least about 25% and generally conditions will be suitable to remove about 30–80%, more preferably about 45–75%, of the sulfur in the feed. When metals such as Ni and V are present in the feed and demetallization is the primary focus the process can be operated at the lower levels of desulfurization. When there is little metal in the feed and demetallization is not the primary goal, one can operate the process at higher sulfur removal rates.

The following examples are provided to illustrate the instant invention and are not to be construed as limiting the invention.

Catalyst Preparation

The following two catalyst preparations describe typical preparations which can be used to prepare a set of catalysts useful in the instant invention.

CATALYST A

Catalyst A contains nickel, molybdenum and phosphorus supported on a gamma alumina carrier, prepared from commercially available alumina powders. This carrier was extruded into 1/16-inch pellets having a trilobe cross section and the pellets were dried and calcined before being impregnated with catalytically active metals by a dry pore volume method i.e., by adding only enough solution to fill the alumina pore volume. Although this carrier contained only alumina, it could have contained a few percent of other components like silica or magnesia, say up to 5%w. An aqueous solution of nickel nitrate, nickel carbonate, phosphoric acid, hydrogen peroxide, and ammonium molybdate was used to impregnate the carrier. The metals loading and the properties of the dried, calcined catalyst are given in Table 2.

CATALYST B

Catalyst B contains cobalt and molybdenum supported on the same alumina carrier used to prepare Catalyst A. This carrier was also extruded into 1/16-inch pellets having a trilobe cross-section and the pellets were dried before being impregnated with catalytically active metals by a dry pore volume method. An aqueous solution of cobalt carbonate, ammonium dimolybdate and ammonia was used to impregnate the carrier. The metals loading and properties of the dried, calcined catalyst are also given in Table 2.

TABLE 2

| Catalyst | A | B |
|---|---|---|
| Diameter | 1/16 -inch | |
| Cross-section | Trilobe | |
| Composition, % w | | |
| Ni | 3.0 | — |
| Co | — | 3.2 |
| Mo | 13.0 | 9.6 |
| P | 3.2 | — |
| Compacted Bulk Density, gm/cc | 0.824 | 0.710 |
| Surface Area, $m^2$/gm | 164 | 226 |
| Hg-Pore Volume, cc/gm | 0.470 | .605 |

Hydrotreating Process

EXAMPLE 1

Three different commercial runs with a main catalyst charge of a Ni-Mo-P/alumina catalyst, a Co-Mo/alumina catalyst and a stacked bed of a Ni-Mo-P/alumina catalyst over a Co-Mo/alumina catalyst have been carried out. FIG. 1 shows the reactor inlet temperature (RIT) necessary to maintain 0.3% weight sulfur in the product; a convenient measure of general catalyst activity. The stacked bed system has good activity and stability for sulfur removal as well as denitrification advantages. The average feed properties and average unit conditions are given in Table 3. The feed is a heavy vacuum gas oil having a final boiling point greater than about 1000° F. and containing less than about 2% by weight of heptane asphaltenes. Feed to the unit and unit conditions were remarkably constant during the runs considering the unit is a commercial unit. For the stacked-bed system the Ni-Mo-P catalyst was about 33% of the main catalyst load while the Co-Mo catalyst made up the remainder of the main catalyst load. Oil and gas flowed in a single stage and serially over first the Ni-Mo-P catalyst and then over the Co-Mo catalyst.

The main advantages of the stacked-bed system shown by this example consist of (a) a significant increase in catalyst stability as can be seen in FIG. 1 where the increase in RIT with time is significantly less for the stacked bed system (about 5° F./month versus about 20° F./month) relative to the single catalyst system; (b) an increase in catalyst activity as represented by about a 13° F. lower initial RIT for the same level of sulfur in the product; (c) a resulting greatly improved estimated catalyst life of about 400% for the stacked bed relative to the single bed due to the improvements in activity and stability. An end of run temperature of 780° F. and a continued linear decline rate was used to estimate the catalyst life of the stacked bed system.

TABLE 3

| HVGO - COMMERCIAL DATA<br>560 PSIG HYDROGEN PARTIAL PRESSURE<br>3.0 LHSV, $HR^{-1}$ | |
|---|---|
| Sulfur, % wt | 1.1 |
| Nickel, ppm | .6 |
| Vanadium, ppm | .7 |
| RCR, % wt | .3 |
| TBP-GLC, °F. | |
| IBP/10% | 509/657 |
| 90/95% | 975/1000 |

EXAMPLE 2

Figure 2:
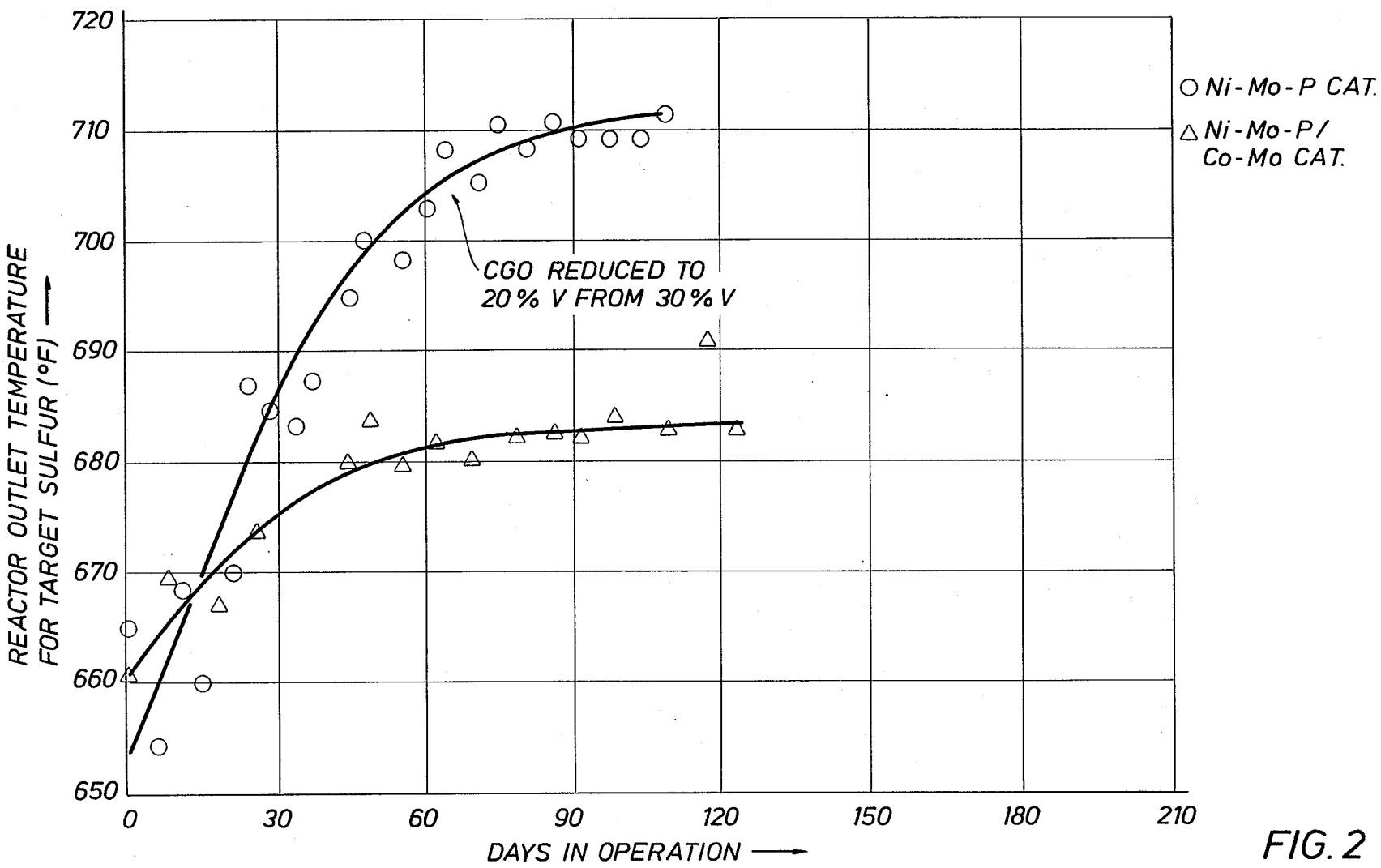
FIG. 2 shows the advantage obtained in the reactor outlet temperature as a function of time when the stacked bed of the instant invention is utilized.

A second set of two commercial runs with a Ni-Mo-P/alumina catalyst and a stacked bed of a Ni-Mo-P/alumina catalyst over a Co-Mo/alumina catalyst has also been carried out. A Ni-Mo-P/alumina catalyst would be one that one skilled in the art would traditionally have chosen for this feedstock when considering hydrogenation, denitrification, and desulfurization catalyst activity rather than a Co-Mo catalyst. Table 4 summarizes the approximate average unit conditions and feed stock. The oil is a blend of straight run vacuum gas oil (distilled from non-cracked oil) and a coker heavy gas oil. Table 5 summarizes the approximate average performance for the two runs at two catalyst ages and FIG. 2 shows the reactor outlet temperature necessary to maintain 0.75% weight and 0.60% weight sulfur in the product for the single catalyst and the stacked bed system.

The main advantages of the stacked-bed system relative to the single bed system shown by this example consist of (a) higher sulfur conversion even at lower operating temperatures, (b) greater catalyst stability when processing the same type feed—about first 60 days—, (c) processing a heavier feed at comparable stabilities—about after 60 days—, and (3) greater hydrogen addition even at lower operating temperatures. FIG. 2 shows that the single bed system has a lower start of run temperature in the first one or two weeks but this temperature is for 0.75% weight sulfur in the product where the temperature for the stacked bed system is for 0.60% weight sulfur in the product. To obtain 0.6% weight sulfur in the product initially with the single bed system about an additional 12° F. would be required thereby making the single bed about 7° F. less active initially. FIG. 2 shows that although the two different catalyst configurations have similar temperatures at the start of run (for the different sulfur targets), the stacked bed system has about a 20° F. advantage after 2 months indicating the greater stability when processing the same type feed containing about 30% by volume of the coker material. After about 60 days the coking tendency of the feed to the single bed system was reduced by decreasing the amount of the full range coker heavy gas oil from about 30% down to 20% by volume (see FIG. 2). The single bed system stability improved with the feed having reduced coking tendency and is beginning to approach that of the stacked bed system although still at the higher sulfur in product level. This data shows that the stacked bed system can be used to process a feed with greater coking tendency with equivalent catalysts life and for this case even with higher sulfur conversion. Table 5 provides some data indicating that the hydrogen consumption of the stacked bed system is better (375 vs. 400 Standard Cubic Feet per Barrel) than that of the single bed system. The best comparison is at the 1 month point where the catalysts are processing the same feed. The larger hydrogen consumption is reflected in the greater temperature rise across the reactor (Reactor delta T in Table 5); hydrogen addition is a major factor in the heat release during hydrotreating.

TABLE 4

FEED PROPERTIES AND OPERATING PARAMETERS

| | | |
|---|---|---|
| Feed | | Vacuum Gas Oil/ Coker Heavy Gas Oil |
| Ratio | | 40/60 |
| End Point, °F. | | above 1000 |
| Feed Sulfur, % W | | ~3 |
| LHSV, $HR^{-1}$ | | 2.76 |
| $H_2$ Pressure, Reactor Inlet, PSIA | | 725 |
| $H_2$/Oil Ratio, SCF/B | | 1700 |
| Stock | HVY VGO | COKER HGO |
| API Gravity @ 60° F. | 19.2 | 18.2 |
| Density @ 60° F. G/CC | 0.939 | 0.945 |
| Molecular weight | 369 | 312 |
| Carbon. % W | 85.41 | 85.22 |
| Hydrogen. % W | 11.80 | 11.04 |
| Sulfur. % W | 2.5 | 3.20 |
| Distillation. °F. | TBP-GLC | TBP-GLC |
| 5% | 630 | 525 |
| 10% | 665 | 571 |
| 25% | 725 | 648 |
| 50% | 803 | 739 |
| 75% | 880 | 832 |
| 90% | 974 | 923 |
| 91.2% | 1000 | |
| 94.2% | | |
| 95.0% | | 1000 |

TABLE 5

CATALYST AND PERFORMANCE

| Catalyst Age | 1 Month | | 4 Months | |
|---|---|---|---|---|
| Catalyst* | 1 | 1 & 2 | 1 | 1 & 2 |
| Reactor Temp., Out, °F. | 680 | 675 | 710 | 685 |
| Reactor delta T, °F. | 60 | 65 | 55 | 65 |
| $H_2$ Consumption, SCF/B | 375 | 400 | 375 | 400 |
| Product Sulfur, % W | 0.75 | 0.6 | 0.75 | 0.6 |

*catalyst 1 is Ni—Mo—P
catalyst 2 is Co—Mo

EXAMPLE 3

A third set of two commercial runs with a Ni-Mo-P/alumina catalyst and a stacked bed of a Ni-Mo-P/alumina catalyst and a Co-Mo/alumina catalyst were also made. The feed used has a final boiling point between 650° F. and 1000° F. Table 6 summarizes the approximate average unit conditions and feed stock properties. Analysis of the data for these two runs showed that the stacked bed of the instant invention, when compared to the single catalyst, showed the following advantages:

(a) lower inlet temperature, (b) lower sulfur in the product, and (c) the ability to operate at the same reactor delta temperature even though the reactor inlet temperature was lower.

TABLE 6

FEED PROPERTIES AND OPERATING PARAMETERS

| Feed Blend | SRLGO/Coker Naphtha/ Coker LGO/LCO |
|---|---|
| Feed Gravity | 0.9218 |
| Distillation, °F., End Point | ~850 |
| Feed Sulfur, % w | 1.3 |
| LHSV, $HR^{-1}$ | 2.6 |
| $H_2$ Pressure, Reactor Inlet, PSIA | 520 |
| $H_2$/Oil Ratio, SCF/B | 990 |

What is claimed is:

1. A process for hydrotreating hydrocarbon oils having a tendency to deactivate hydrotreating catalysts by coke formation, said oils selected from the group consisting of (a) oils having a final boiling point greater than about 1000° F. and containing less than about 2% by weight of heptane asphaltenes, (b) oils having a final boiling point from about 850° F. to about 1000° F. and (c) mixtures thereof, which comprises:

passing said oils downwardly with a hydrogen-containing gas into a hydrotreating zone over a stacked-bed of two hydrotreating catalysts under conditions to convert greater than about 25% of the sulfur compounds present to $H_2S$; said stacked bed comprising an upper bed consisting of about 15–85%v, basis total catalyst, of a high-activity hydrotreating catalyst containing from about 2–4%w nickel, from about 8–15%w molybdenum and from about 1–4%w phosphorus supported on a carrier consisting mostly of alumina, said catalyst having a compacted bulk density of about 0.65–0.95 gm/cc and a surface area greater than about 140 $m^2$/gm; and a lower bed consisting of about 15–85%v, basis total catalyst, of a high-activity desulfurization catalyst which contains from about 2–4%w cobalt and/or nickel and from about 8–15%w molybdenum and less than about 0.5%w phosphorus supported on a carrier consisting mostly of alumina, said catalyst having a compacted bulk density of about 0.6–0.8 gm/cc and a surface area greater than about 180 $m^2$/gm; and separating the reaction product from said hydrotreating zone into a hydrogen-rich gas and a liquid hydrocarbon oil having reduced sulfur and/or heavy metal content.

2. The process of claim 1 wherein the lower bed catalyst contains from about 2–4%w cobalt, and essentially no nickel and no phosphorus.

3. The process of claim 1 wherein the lower bed catalyst contains from about 2–4%w nickel, and essentially no cobalt and no phosphorus.

4. The process of claim 1 wherein the phosphorus content of the catalyst in the first bed is from about 2–4% by weight.

5. The process of claim 1 wherein the carrier comprises more than 95%w gamma alumina.

6. The process of claim 5 wherein the upper bed catalyst has a compacted bulk density of about 0.76–0.88 gm/cc and a surface area greater than about 150 $m^2$/gm.

7. The process of claim 5 wherein the lower bed catalyst has a compacted bulk density of about 0.67–0.79 gm/cc and a surface area greater than about 200 $m^2$/gm.

8. The process of claim 1 wherein the hydrotreating zone is contained in a single reactor and the upper bed of catalyst consists of about one-third of the total catalyst volume.

9. The process of claim 1 wherein the upper bed of catalyst constitutes about one-third of the total catalyst volume.

10. A single stage process for hydrocarbon oils having a tendency to deactivate hydrotreating catalysts by coke formation, said oils selected from the group consisting of (a) oils having a final boiling point greater than about 1000° F. and containing less than about 2% by weight of heptane asphaltenes, (b) oils having a final boiling point from about 850° F. to about 1000° F. and (c) mixtures thereof, which comprises:

(a) contacting said oils in a hydrofining zone under hydrotreating conditions with a hydrogen-containing gas and passing said oils and hydrogen-containing gas over a first bed containing a catalyst comprising a carrier, at least 95%w of which is gamma alumina, having supported thereon from about 2–4%w nickel, from about 8–15% molybdenum and from about 1–4%w phosphorus, said bed volume constituting about 15–85% of the total catalyst;

(b) thence over a second bed containing a catalyst comprising a carrier, at least 95%w of which is gamma alumina having supported thereon from about 2–4%w cobalt and/or nickel, from about 8–15%w molybdenum and less than about 0.5%w phosphorus; and (c) separating the reaction product from the hydrofining zone into a hydrogen-rich gas and a hydrotreated liquid oil product.

11. The process of claim 10 wherein the catalyst in the lower bed contains from about 2–4%w cobalt, and essentially no nickel and no phosphorus.

12. The process of claim 10 wherein the catalyst in the lower bed contains from about 2–4%w nickel and essentially no cobalt and no phosphorus.

13. The process of claim 10 wherein the phosphorus content of the catalyst in the first bed is from about 2–4% by weight.

14. The process of claim 10 wherein the hydrotreating conditions are hydrodesulfurization conditions.

15. The process of claim 10 wherein the first bed of catalyst constitutes about one-third of the total catalyst volume.

16. The process of claim 10 wherein the first bed hydrofining catalyst has a compacted bulk density of about from 0.65 to 0.95 gm/cc and a surface area of more than 140 $m^2$/gm and wherein the second bed of hydrofining catalyst has a compacted bulk density of 0.6–0.8 gm/cc and a surface area greater than 180 $m^2$/gm.

17. The process of claim 16 wherein the first bed catalyst has a compacted bulk density of about 0.76–0.88 gm/cc and a surface area greater than about 150 $m^2$/gm and wherein the second bed catalyst has a compacted bulk density of about 0.67–0.79 gm/cc and a surface area greater than about 200 $m^2$/gm.

18. A process for hydrotreating hydrocarbon oils having a tendency to deactivate hydrotreating catalysts by coke formation, said oils having a final boiling point greater than about 1000° F. and containing less than about 2% by weight of heptane asphaltenes, passing said oils downwardly with a hydrogen-containing gas into a hydrotreating zone over a stacked-bed of two hydrotreating catalysts under conditions suitable to convert greater than about 25% of the sulfur compounds present to $H_2S$; said stacked bed comprising an upper bed consisting of about 15–85%v, basis total catalyst, of a high-activity hydrotreating catalyst containing from about 2–4%w nickel, from about 8–15%w molybdenum and from about 1–4%w phosphorus supported on a carrier consisting mostly of alumina, said catalyst having a compacted bulk density of about 0.65–0.95 gm/cc and a surface area greater than about 140 $m^2$/gm; and a lower bed consisting of about 15–85%v, basis total catalyst, of a high-activity desulfurization catalyst which contains from about 2–4%w cobalt and/or nickel and from about 8–15%w molybdenum and less than about 0.5%w phosphorus supported on a carrier consisting mostly of alumina, said catalyst having a compacted bulk density of about 0.6–0.8 gm/cc and a surface area greater than about 180 $m^2$/gm; and separating the reaction product from said hydrotreating zone into a hydrogen-rich gas and a liquid hydrocarbon oil having reduced sulfur and/or heavy metal content.

19. The process of claim 18 wherein the lower bed catalyst contains from about 2–4%w cobalt, and essentially no nickel and no phosphorus.

20. The process of claim 18 wherein the lower bed catalyst contains from about 2–4%w nickel, and essentially no cobalt and no phosphorus.

21. The process of claim 18 wherein the phosphorus content of the catalyst in the first bed is from about 2–4% by weight.

22. The process of claim 18 wherein the carrier comprises more than 95%w gamma alumina.

23. The process of claim 22 wherein the upper bed catalyst has a compacted bulk density of about 0.76–0.88 gm/cc and a surface area greater than about 150 $m^2$/gm.

24. The process of claim 22 wherein in the lower bed catalyst has a compacted bulk density of about 0.67–0.79 gm/cc and a surface area greater than about 200 $m^2$/gm.

25. The process of claim 18 wherein the hydrotreating zone is contained in a single reactor and the upper bed of catalyst consists of about one-third of the total catalyst volume.

26. The process of claim 18 wherein the upper bed of catalyst constitutes about one-third of the total catalyst volume.

27. A single stage process for hydrocarbon oils having a tendency to deactivate hydrotreating catalysts by coke formation, said oils having a final boiling point greater than about 1000° F. and containing less than about 2% by weight of heptane asphaltenes:

(a) contacting said oils in a hydrofining zone under hydrotreating conditions with a hydrogen-containing gas and passing said oils and hydrogen-containing gas over a first bed containing a catalyst comprising a carrier, at least 95%w of which is gamma alumina, having supported thereon from about 2–4%w nickel, from about 8–15% molybdenum and from about 1–4%w phosphorus, said bed volume constituting about 15–85% of the total catalyst;

(b) thence over a second bed containing a catalyst comprising a carrier, at least 95%w of which is gamma alumina having supported thereon from about 2–4%w cobalt and/or nickel, from about 8–15%w molybdenum and less than about 0.5%w phosphorus; and (c) separating the reaction product from the hydrofining zone into a hydrogen-rich gas and a hydrotreated liquid oil product.

28. The process of claim 27 wherein the catalyst in the lower bed contains from about 2–4%w cobalt, and essentially no nickel and no phosphorus.

29. The process of claim 27 wherein the catalyst in the lower bed contains from about 2–4%w nickel and essentially no cobalt and no phosphorus.

30. The process of claim 27 wherein the phosphorus content of the catalyst in the first bed is from about 2–4% by weight.

31. The process of claim 27 wherein the hydrotreating conditions are hydrodesulfurization conditions.

32. The process of claim 27 wherein the first bed of catalyst constitutes about one-third of the total catalyst volume.

33. The process of claim 27 wherein the first bed hydrofining catalyst has a compacted bulk density of about from 0.65 to 0.95 gm/cc and a surface area of more than 140 $m^2$/gm and wherein the second bed of hydrofining catalyst has a compacted bulk density of 0.6–0.8 gm/cc and a surface area greater than 180 $m^2$/gm.

34. The process of claim 33 wherein the first bed catalyst has a compacted bulk density of about 0.76–0.88 gm/cc and a surface area greater than about 150 $m^2$/gm and wherein the second bed catalyst has a compacted bulk density of about 0.67–0.79 gm/cc and a surface area greater than about 200 $m^2$/gm.

* * * * *